US009390699B2

(12) United States Patent
Huang

(10) Patent No.: US 9,390,699 B2
(45) Date of Patent: Jul. 12, 2016

(54) PICKUP DEVICE FOR A STRING INSTRUMENT

(71) Applicant: Hai-Ping Huang, Tainan (TW)

(72) Inventor: Hai-Ping Huang, Tainan (TW)

( * ) Notice: Subject to any disclaimer, the term of this patent is extended or adjusted under 35 U.S.C. 154(b) by 0 days.

(21) Appl. No.: 14/789,251

(22) Filed: Jul. 1, 2015

(65) Prior Publication Data

US 2016/0005388 A1 Jan. 7, 2016

(30) Foreign Application Priority Data

Jul. 2, 2014 (TW) ..... 103211729 U

(51) Int. Cl.

| | |
|---|---|
| ***G10H 3/18*** | (2006.01) |
| ***G10H 1/32*** | (2006.01) |
| ***G10H 1/00*** | (2006.01) |
| ***G10G 5/00*** | (2006.01) |
| ***G10G 7/00*** | (2006.01) |

(52) U.S. Cl.

CPC ..... *G10H 3/181* (2013.01); *G10G 5/005* (2013.01); *G10G 7/00* (2013.01); *G10H 1/0083* (2013.01); *G10H 1/32* (2013.01); *G10H 3/18* (2013.01); *G10H 3/183* (2013.01); *G10H 2230/075* (2013.01)

(58) Field of Classification Search

CPC ..... G10H 3/18; G10H 3/181; G10H 3/183
USPC ..... 84/736, 731
See application file for complete search history.

(56) References Cited

U.S. PATENT DOCUMENTS 2,261,358 A * 11/1941 Fuller ..... G10H 3/181 84/723
2,310,606 A * 2/1943 Barth ..... G10H 3/181 84/726
3,763,736 A * 10/1973 Williams ..... G10H 3/181 84/329
3,780,202 A * 12/1973 Law ..... G10H 3/183 84/269
4,168,647 A * 9/1979 Petillo ..... G10H 3/181 84/114
4,387,621 A * 6/1983 Franzmann ..... G10H 3/18 84/735
4,404,885 A * 9/1983 Salak ..... G10D 3/00 248/231.41
4,854,210 A * 8/1989 Palazzolo ..... G10H 3/181 84/726
5,252,777 A * 10/1993 Allen ..... G10H 3/182 84/726
5,270,474 A * 12/1993 Kun ..... G10D 3/18 84/280
5,614,688 A * 3/1997 Donnell ..... G10H 3/181 84/743

(Continued)

*Primary Examiner* — David Warren
(74) *Attorney, Agent, or Firm* — Muncy, Geissler, Olds & Lowe, P.C.

(57) ABSTRACT

A pickup device for a string instrument includes a base unit to be disposed at a rear side of the string instrument, a securing unit disposed on the base unit and configured to secure removably the base unit to the string instrument, and a sound pickup unit mounted to the base unit and configured to generate an electrical sound signal in response to a sound received thereby.

12 Claims, 6 Drawing Sheets

(56) References Cited

U.S. PATENT DOCUMENTS 6,031,163 A * 2/2000 Cullum ..... G10D 3/18 84/278
6,043,422 A * 3/2000 Chapman ..... G10H 1/32 84/723
6,274,801 B1 * 8/2001 Wardley ..... G10H 3/146 84/275
6,278,044 B1 * 8/2001 Ruan ..... G10D 3/18 84/279
6,369,303 B1 * 4/2002 Hvezda ..... G10D 3/18 84/278
6,441,292 B1 * 8/2002 Donnell ..... G10H 3/12 84/723
7,390,950 B2 * 6/2008 Hollander ..... H04R 1/08 84/290
8,212,137 B1 * 7/2012 Hosler ..... G10H 3/181 84/743
8,455,749 B1 * 6/2013 Gage ..... G10H 3/181 84/730
8,586,850 B1 * 11/2013 Turner ..... G10H 1/32 84/726
8,957,290 B2 * 2/2015 Vochezer ..... G10D 3/18 84/280
2003/0167896 A1 * 9/2003 Vanden ..... G10D 3/18 84/279
2006/0278067 A1 * 12/2006 Suzuki ..... G10H 3/18 84/737
2008/0168884 A1 * 7/2008 Redard ..... G10H 3/183 84/329
2009/0183626 A1 * 7/2009 Salehi ..... G10H 3/181 84/726
2011/0211713 A1 * 9/2011 Cavallo-Romano ... G10H 3/186 381/118
2013/0276622 A1 * 10/2013 Bartig ..... G10H 3/181 84/731
2014/0224099 A1 * 8/2014 Webman ..... G10H 3/18 84/630

* cited by examiner

PICKUP DEVICE FOR A STRING INSTRUMENT

CROSS-REFERENCE TO RELATED APPLICATION

This application claims priority of Taiwanese Application No. 103211729, filed on Jul. 2, 2014.

FIELD

The invention relates to a pickup device, and more particularly to a pickup device that is suitable for a string instrument and that may have a support function similar to a shoulder rest.

BACKGROUND

Traditional string instruments usually have a resonance box portion for increasing volume or for changing tone quality. However, in order to facilitate sound reception and music recording, a variety of electronic string instruments have been developed. The electronic string instruments omit the structure of the resonance box, employ a pickup device for directly receiving sounds generated by strings, and transmit electrical sound signals transformed thereby to a speaker system for output using wired or wireless data transmission techniques. However, direct sound reception from the strings may lead to loss of unique tone quality of resonance resulting from the traditional resonance box structure. In addition, since the string instruments only have limited positions for installation of conventional pickup devices, different pickup devices that are designed for different audio frequency ranges (e.g., low, middle, and high audio frequency ranges) may be unable to be installed on the string instruments at the same time.

SUMMARY

Therefore, an object of the present invention is to provide a pickup device that may be secured to a string instrument for facilitating a user to hold and play the string instrument, and for receiving sounds from a resonance box portion of the string instrument.

According to the present invention, a pickup device for a string instrument includes:

abase unit to be disposed at a rear side of the string instrument;

a securing unit disposed on the base unit and configured to secure removably the base unit to the string instrument; and a sound pickup unit mounted to the base unit and configured to generate an electrical sound signal in response to a sound received thereby.

BRIEF DESCRIPTION OF THE DRAWINGS

Other features and advantages of the present invention will become apparent in the following detailed description of an embodiment with reference to the accompanying drawings, of which.

DETAILED DESCRIPTION

Figure 1:
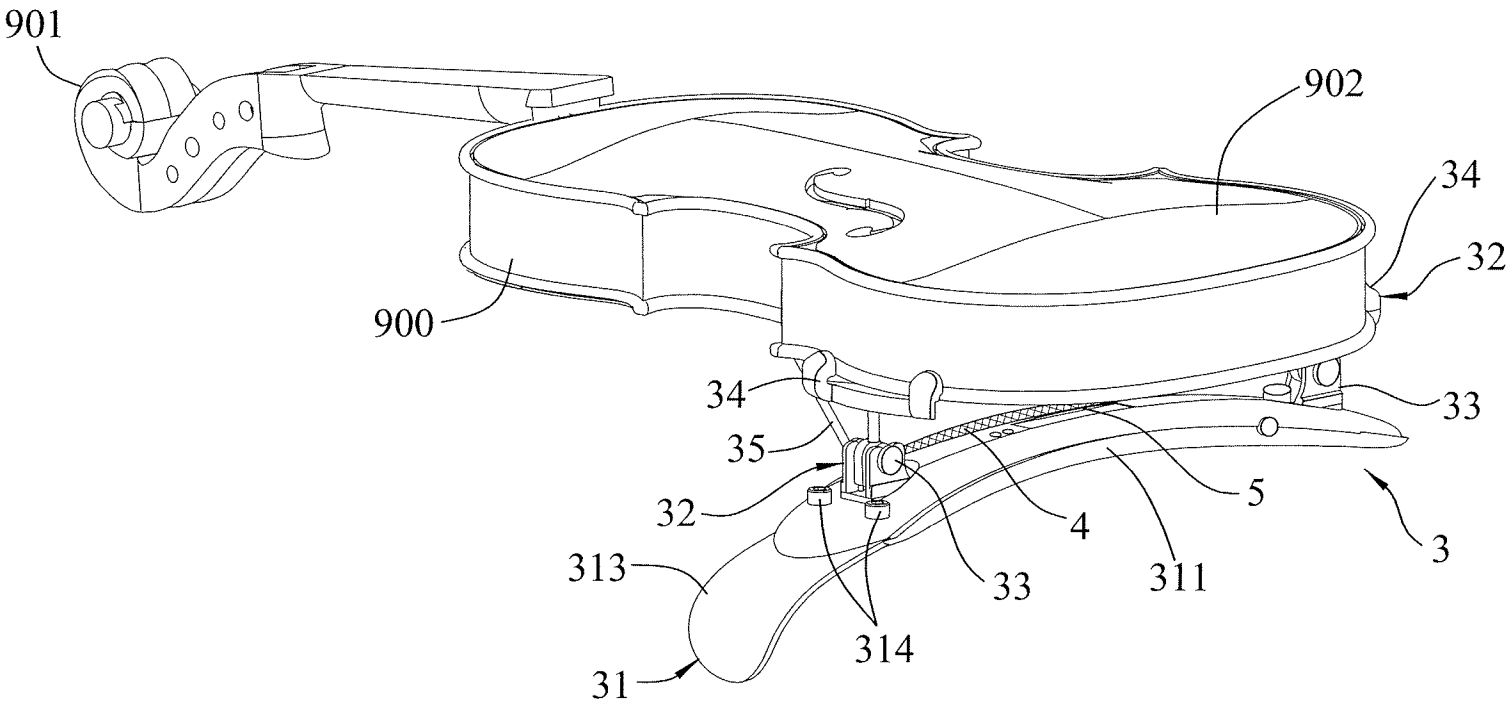
FIG. 1 is a perspective view showing an embodiment of the pickup device according to the invention, the pickup device being secured to a string instrument.
Figure 5:
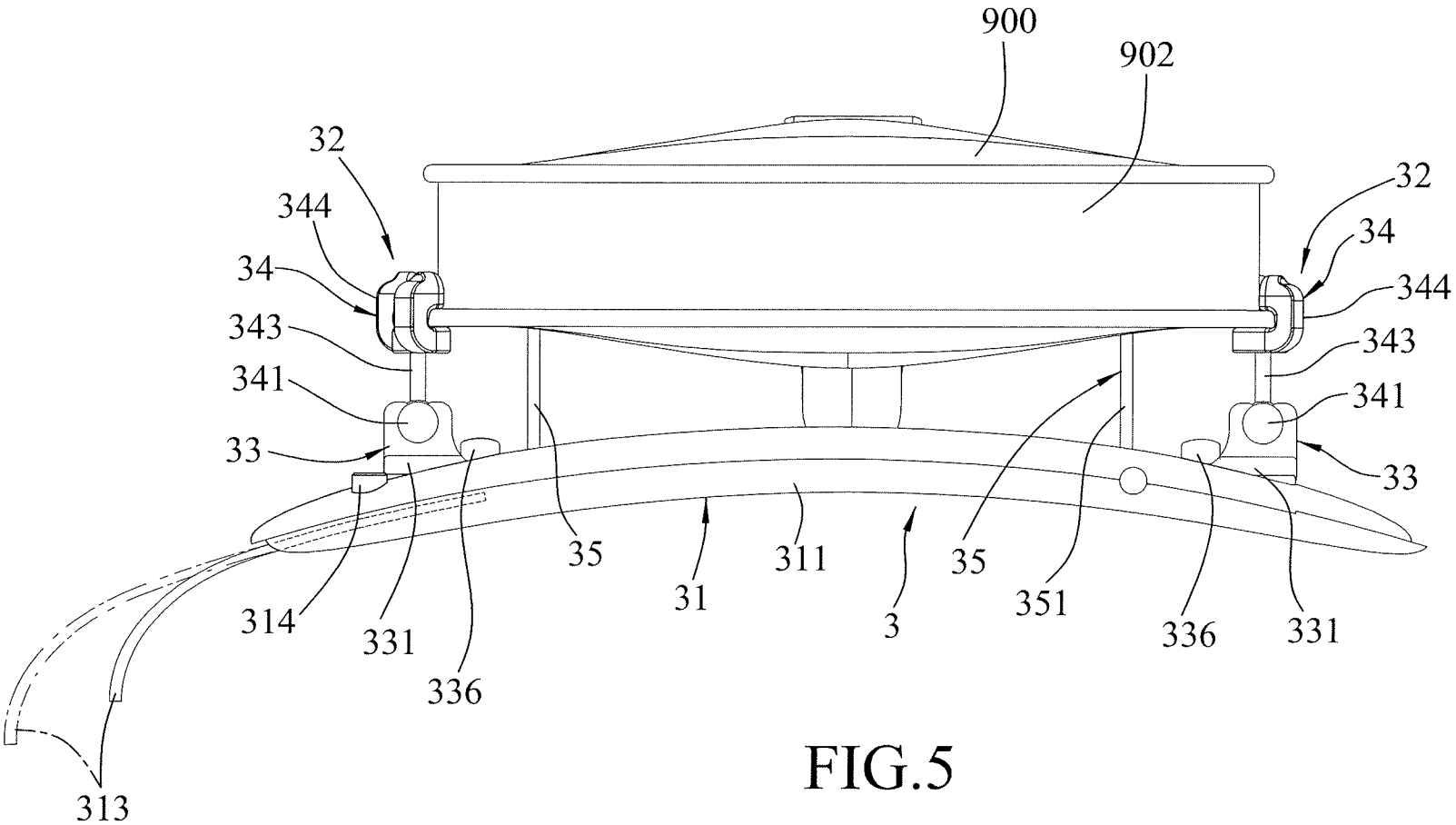
FIG. 5 is a side view of the embodiment secured to the string instrument.
Figure 6:
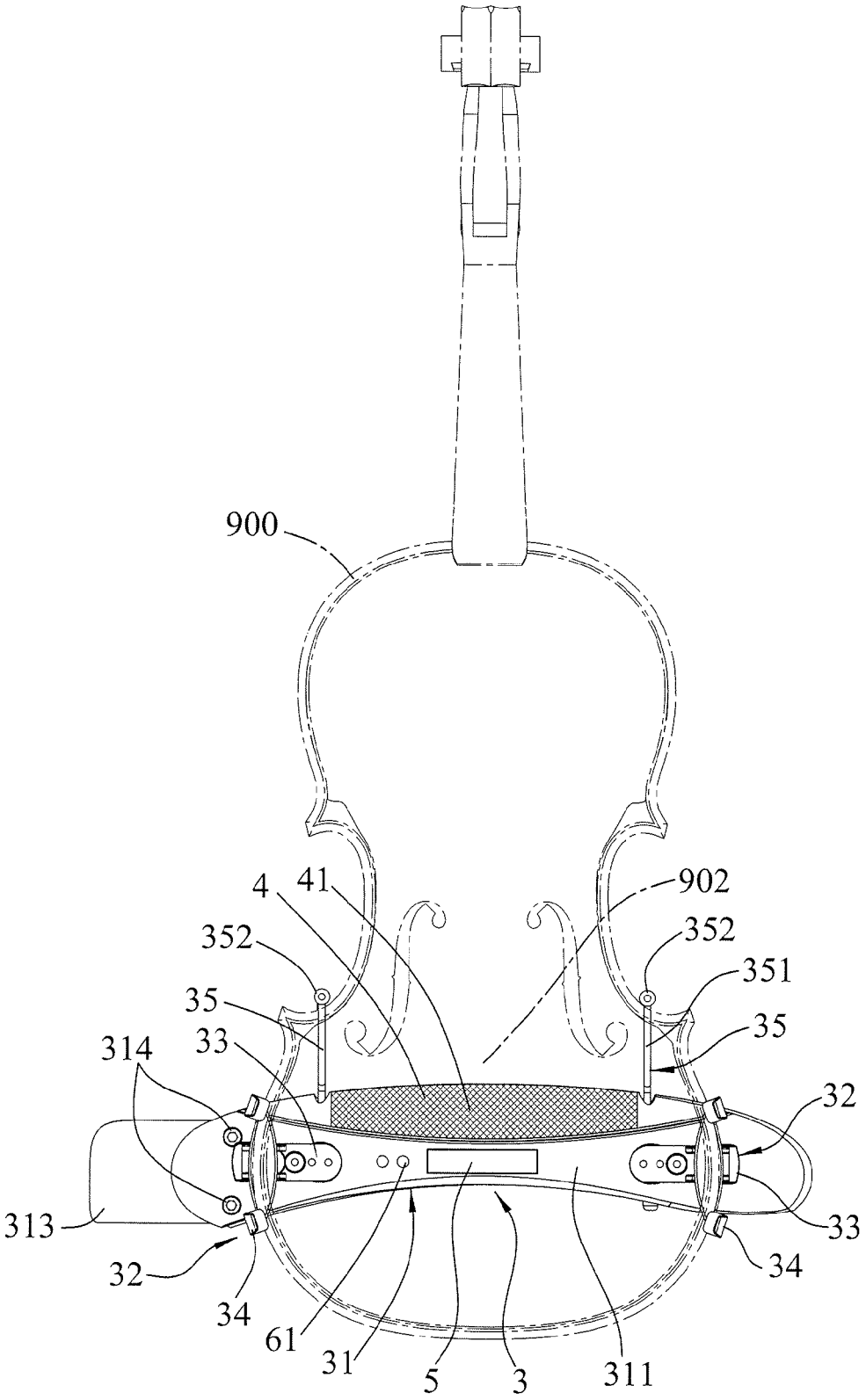
FIG. 6 is a top view of the embodiment when the embodiment is secured to the string instrument.

Referring to FIGS. 1, 5 and 6, the embodiment of the pickup device according to this invention is shown to be secured to a string instrument 900 during use, and is configured to wirelessly communicate with a speaker system (not shown). The string instrument 900 has a head portion 901 and a resonance box portion 902, and may be, but is not limited to, a violin, a viola, a cello, a guitar, etc. In this embodiment, the string instrument 900 is exemplified using a violin.

In this embodiment, the pickup device includes a securing structure 3 for securing to the string instrument 900, a sound pickup unit 4, a display unit 5 and a wireless communication unit 6 (see FIG. 2) disposed on the securing structure 3. By means of the securing structure 3, a user is able to firmly hold the string instrument 900.

Figure 2:
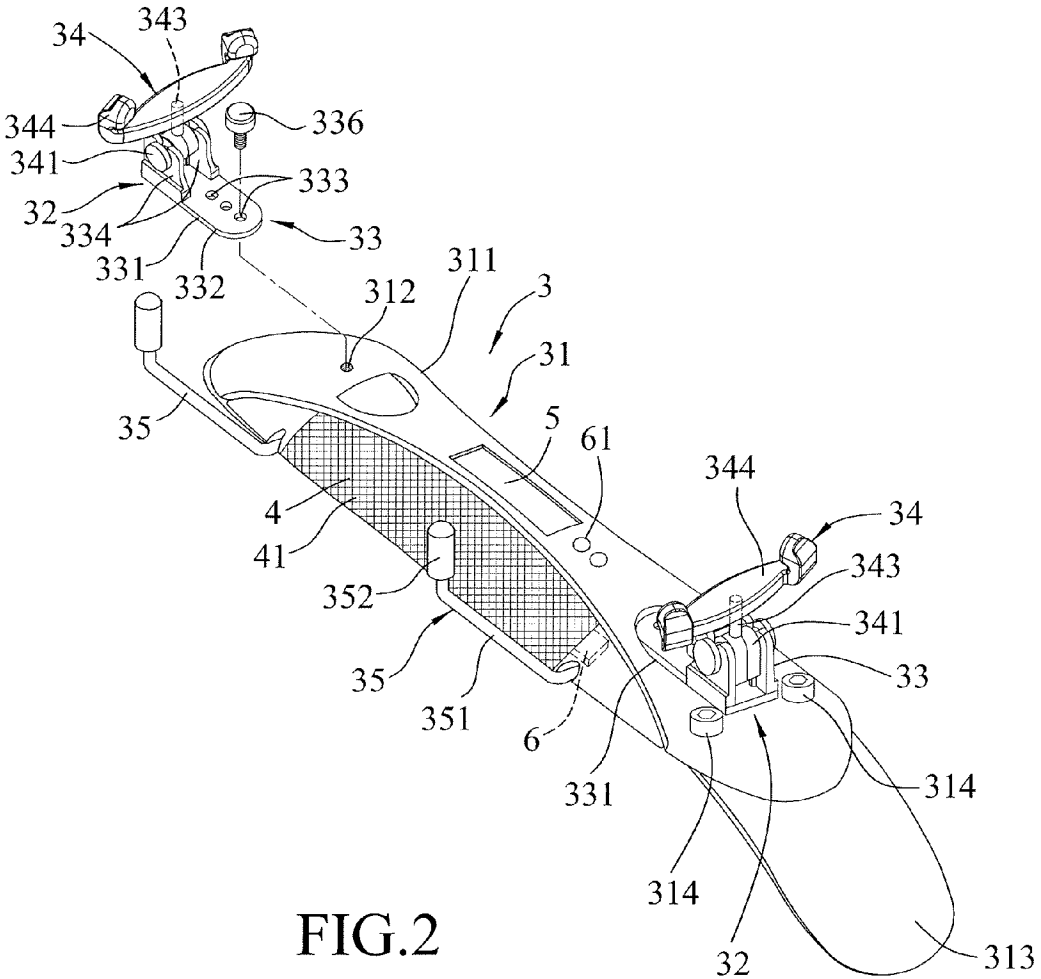
FIG. 2 is a partly exploded perspective view showing components of the embodiment.
Figure 3:
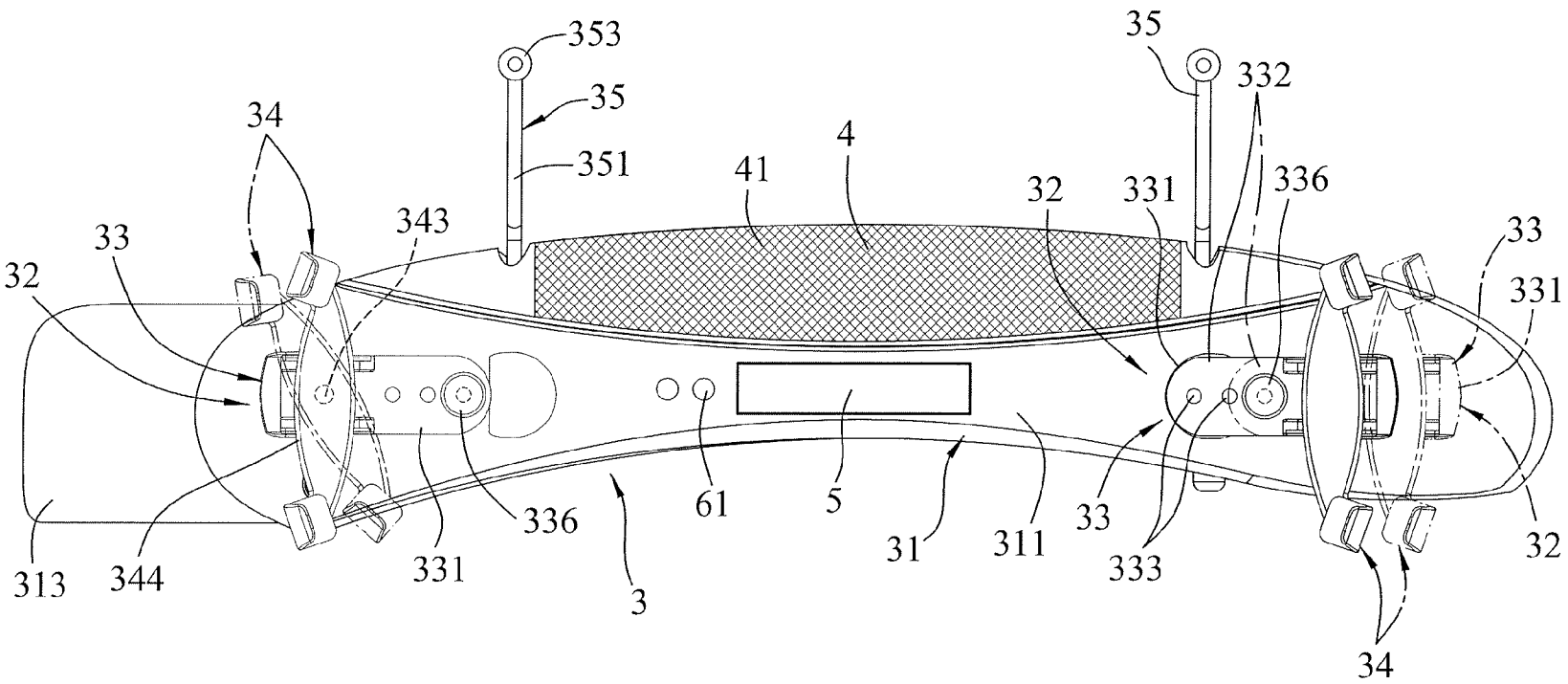
FIG. 3 is a top view of the embodiment to illustrate rotation and translation of clamping components of the embodiment.

Referring to FIGS. 2, 3 and 5, the securing structure 3 includes: an elongated base unit 31 that extends in an extension direction that corresponds to a left-right direction of the string instrument 900 when the pickup device is secured to the string instrument 900; a pair of clamping members 32 that are disposed on the base unit 31 and that cooperatively form a securing unit for securing removably the base unit 31 to the string instrument 900 at a rear side of the string instrument 900; and a pair of resilient hook units 35 that are mounted to the base unit 31 at a head-portion side and that extend toward the head portion 901 (see FIG. 1) of the string instrument 900 to resiliently and hookably engage the string instrument 900 in a longitudinal direction of the string instrument 900.

The base unit 31 includes: a base body 311 that extends in the extension direction and that is configured for disposing the clamping members 32 and the hook units 35 thereon; a plate 313 mounted to and movable along one of longitudinal end parts of the base body 311 that are disposed along the extension direction, and bending away from the securing unit; and a pair of fixing components 314 for fixing an extended length of the plate 313 with respect to the base body 311. In application, the fixing components 314 are threaded components that may be loosened for facilitating adjustment of the extended length of the plate 313, and may be tightened after adjustment. Furthermore, the base body 311 has a pair of fixing holes 312 (only one is visible in FIG. 2) respectively disposed at the longitudinal end parts of the base body 311.

Referring to FIGS. 2 and 5, the clamping members 32 are respectively disposed at top surfaces of two end portions of the base body 311 that are disposed along the extension direction. Each clamping member 32 includes: a positioning mechanism 33 configured to position the clamping member 32 on the base unit 31 in the extension direction; and a clamping component 34 pivotally mounted to the positioning mechanism 33 for rotation about an axis transverse to the extension direction between a functional position and a non-functional position. At the functional position, the clamping component 34 abuts against a rear surface and a side surface of the resonance box portion 902, so that the string instrument 900 may be clamped between the clamping components 34 when both of the clamping components 34 are at the functional position. When the clamping component 34 is at the non-functional position, the clamping component 34 is folded toward the base unit 31.

Figure 4:
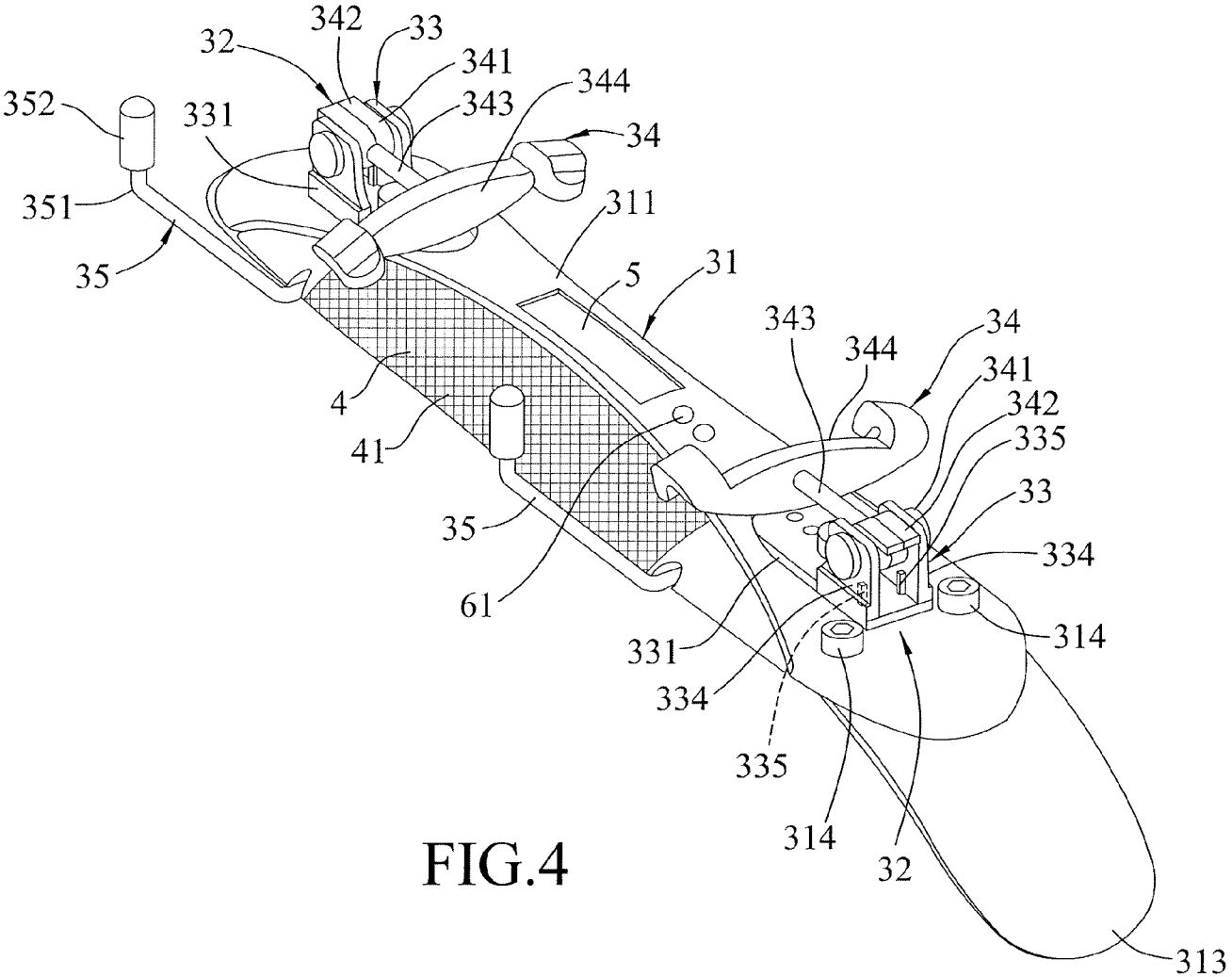
FIG. 4 is a perspective view showing the embodiment from another viewing angle.

Referring to FIGS. 2 and 3, the positioning mechanism 33 includes a positioning seat 331 disposed on a top surface of the base body 311, and a positioning bolt 336 for mounting the positioning seat 331 on the base body 311. The positioning seat 331 has a positioning wall 332 formed with a plurality of positioning holes 333 spaced apart from each other in the extension direction, and a pair of pivot lugs 334 spaced apart from each other in a direction transverse to the extension direction and extending from the positioning wall 332 toward the clamping component 34. The positioning bolt 336 is inserted into one of the positioning holes 333, and is threadedly engaged with the corresponding fixing hole 312, thereby adjustably positioning the positioning seat 331 on the base body 311. Referring to FIG. 4, in this embodiment, each of the pivot lugs 334 has a stop 335 that protrudes toward the other one of the pivot lugs 334.

Referring to FIGS. 3 to 5, each of the clamping components 34 includes: a pivot connection portion 341 pivotally mounted to the positioning mechanism 33 between the pivot lugs 334 for rotation about a pivot axis; a rod portion 343 having a rod axis transverse to the pivot axis, a first end pivotally mounted to the pivot connection portion 341 for rotation about the rod axis, and a second end opposite to the first end; and an abutment portion 344 mounted to the second end of the rod portion 343. The abutment portion 344 is configured to abut against the resonance box portion 902 when the clamping component 34 is at the functional position. The pivot connection portion 341 has a limiting part 342 protruding from an outer peripheral surface thereof. When the clamping component 34 is rotated from the non-functional position to the functional position, the limiting part 342 abuts against the stops 335, and the clamping component 34 is thus limited at the functional position.

Each resilient hook unit 35 includes a resilient hook 351 having one end connected removably to the base body 311, and another end provided with a cushion 352 to abut against a surface of the string instrument 900. The hook 351 is configured to extend from the base body 311 toward the head portion 901 (see FIG. 1) of the string instrument 900, and bends incliningly toward the string instrument 900 when the pickup device of this embodiment is secured to the string instrument 900.

Referring again to FIGS. 1, 2 and 6, the sound pickup unit 4 is configured to be disposed at a rear side of the resonance box portion 902 of the string instrument 900, is mounted to the base body 311 at the head-portion side, and has a sound receiving surface 41 facing toward the resonance box portion 902 for receiving a sound therefrom. The sound receiving surface 41 is disposed between the clamping members 32 and extends in the extension direction. The sound pickup unit 4 is configured to generate an electrical sound signal in response to the sound received thereby. Since the sound receiving surface 41 of the pickup device of this embodiment may be larger than that of conventional pickup devices by virtue of integration with the base unit 31, the sound pickup unit 41 may be designed to have several sound pickup components (not shown) respectively designed for a low audio frequency, a middle audio frequency, a high audio frequency, and/or a particular frequency range, thereby favoring professional sound pickup operation. In practice, a sound pickup direction or a position of the sound pickup unit 4 is adjustable according to a best resonance point of the resonance box portion 902 of the applicable string instrument 900, so as to acquire the tone quality of the resonance structure of the string instrument 900. The abovementioned effects may not be achieved using conventional pickup devices that directly and only receive sounds from the strings at a nearby position. Moreover, since the sound pickup unit 4 is disposed at the rear side of the string instrument 900, noise at the front side of the string instrument 900 may be blocked, resulting in promotion of received sound quality.

The wireless communication unit 6 is mounted to the base unit 31, is communicatively coupled to the sound pickup unit 4 for receiving the electrical sound signal, and wirelessly transmits the electrical sound signal to a speaker system. The wireless communication unit 6 includes a channel setting member 61 for setting a wireless communication channel used for communication between the wireless communication unit 6 and the speaker system. The display unit 5 is mounted to the base unit 31, and displays identification information of the wireless communication channel.

Referring to FIGS. 2, 5 and 6, a user may use the pickup device of this embodiment in the following manner:

First, the channel setting member 61 may be operated to set the wireless communication channel used between the wireless communication unit 6 and the speaker system.

Second, the securing structure 3 may be secured to the string instrument 900 by placing the abutment portions 344 against the rear surface and the side surface of the resonance box portion 902, so as to clamp the resonance box portion 902 between the clamping members 32 in the left-right direction.

Third, the hook units 35 may be pulled to place the cushions 352 against the resonance box portion 902 at the head-portion side thereof, thereby hookably engaging the resonance box portion 902, and cooperating with the clamping components 34 to clamp the resonance box portion 902 thereamong, and to position the base unit 31 on the string instrument 900. At this time, the sound pickup unit 4 is disposed at the rear side of the resonance box portion 902. Since the hook units 35 are removably inserted into the base unit 31, the hook units 35 may be removed when the hook units 35 are not required.

Finally, the user may adjust the extended length of the plate 313 in the left-right direction as desired.

When playing the string instrument 900, the user may place the plate 313 on the shoulder. Since the plate 313 bends downwardly, the plate 313 may be firmly placed on the shoulder of the user. During playing of the string instrument 900, the sound pickup unit 4 receives the sounds that are generated by resonance of the resonance box portion 902 and that have the tone quality of resonance, and transforms the sounds into electrical sound signals. Then, the wireless communication unit 6 wirelessly transmits the electrical sound signals to the speaker system for sound amplification and output.

In this embodiment, the pickup device is configured to be secured to a violin for a user to hold the violin on the shoulder. When the pickup device with the disclosed structure is applied to other string instruments, the pickup device may also serve as a support when the string instrument is lying or for the user to lean thereagainst during playing.

In summary, by virtue of integrating the sound pickup unit 4 and the wireless communication unit 6 with the securing structure 3, the pickup device of this disclosure may be firmly secured to the string instrument 900 for facilitating the user to hold and play the string instrument 900, and the sound pickup unit 4 may directly receive the sounds at the rear side of the resonance box portion 902 of the string instrument 900 for completely obtaining the unique tone quality of resonance. Since the electrical sound signals are wirelessly transmitted to the speaker system, attachment of additional wiring or wireless microphone to the user and/or the string instrument 900 is not required, thereby preventing performance of the user from being interfered by added accessories, and completely presenting the elegant appearance of the string instrument 900. In addition, the sound pickup unit 4 extends in the extension direction of the securing structure 3 that crosses the resonance box portion 902 at the rear side, thereby facilitating design of a broad sound receiving range, blocking noise from the front side of the string instrument 900, and promoting sound quality received thereby.

While the disclosure has been described in connection with what is (are) considered the exemplary embodiment (s), it is understood that this disclosure is not limited to the disclosed embodiment(s) but is intended to cover various arrangements included within the spirit and scope of the broadest interpretation so as to encompass all such modifications and equivalent arrangements.

What is claimed is:

1. A pickup device for a string instrument having a resonance box portion, comprising:

a base unit to be disposed at a rear side of the string instrument;

a securing unit disposed on said base unit and configured to secure removably said base unit to the string instrument; and a sound pickup unit mounted to said base unit and configured to generate an electrical sound signal in response to a sound received thereby;

wherein:

said securing unit includes a pair of clamping members spaced apart from each other in a first direction and configured to clamp the resonance box portion therebetween; and said pickup device includes a resilient hook unit mounted to said base unit, and configured to resiliently and hookably engage the string instrument in a second direction transverse to the first direction, and to cooperate with said clamping members to position said base unit on the string instrument.

2. The pickup device according to claim 1, wherein said base unit is elongated and extends in an extension direction, said sound pickup unit having a sound receiving surface that is disposed to face toward the string instrument for receiving the sound and that extends in the extension direction.

3. The pickup device according to claim 2, the string instrument having a resonance box portion, wherein:

said securing unit includes a pair of clamping members spaced apart from each other in the extension direction, and configured to clamp the resonance box portion therebetween; and said sound receiving surface is disposed between said clamping members.

4. The pickup device according to claim 1, wherein said resilient hook unit includes a resilient hook having one end connected removably to said base unit, and another end provided with a cushion to abut against a surface of the string instrument.

5. The pickup device according to claim 1, the string instrument having a resonance box portion, wherein:

said securing unit includes a pair of clamping members spaced apart from each other in a first direction, and configured to clamp the resonance box portion therebetween, each of said clamping members including:

a positioning mechanism configured to position said clamping member on said base unit; and a clamping component pivotally mounted to said positioning mechanism for rotation between a functional position at which said clamping component is disposed to abut against the resonance box portion, and a non-functional position at which said clamping component is folded toward said base unit.

6. The pickup device according to claim 5, wherein said base unit includes:

a base body extending in the first direction, and configured for disposing said positioning mechanism of each of said clamping members thereon;

a plate mounted to and movable along one of longitudinal end parts of said base body that are disposed along the first direction, and bending away from said securing unit; and a fixing component for fixing an extended length of said plate with respect to said base body.

7. The pickup device according to claim 5, wherein each of said clamping components includes:

a pivot connection portion pivotally mounted to said positioning mechanism for rotation about a pivot axis;

a rod portion having a first end mounted to said pivot connection portion, and a second end opposite to said first end, said rod portion having a rod axis transverse to the pivot axis; and an abutment portion mounted to said second end of said rod portion, and configured to abut against the resonance box portion when said clamping component is in the functional position.

8. The pickup device according to claim 7, wherein:

each of said longitudinal end parts of said base body is formed with a fixing hole;

said positioning mechanism of each of said clamping members has:

a positioning seat disposed on said base body and having a pair of pivot lugs, said clamping component being pivotally mounted between said pivot lugs, at least one of said pivot lugs having a stop that protrudes toward the other one of said pivot lugs; and a positioning bolt for mounting said positioning seat on said base body; and said pivot connection portion has a limiting part configured to abut against said stop when said clamping component is in the functional position.

9. The pickup device according to claim 1, further comprising a wireless communication unit mounted to said base unit, communicatively coupled to said sound pickup unit for receiving the electrical sound signal, and configured to wirelessly transmit the electrical sound signal.

10. The pickup device according claim 9, wherein said wireless communication unit includes a channel setting member for setting a wireless communication channel used by said wireless communication unit, said pickup device being further characterized by a display unit mounted to said base unit and configured to display identification information of the wireless communication channel used by said wireless communication unit.

11. A pickup device for a string instrument having a resonance box portion, comprising:

a base unit to be disposed at a rear side of the string instrument;

a securing unit disposed on said base unit and configured to secure removably said base unit to the string instrument; and a sound pickup unit mounted to said base unit and configured to generate an electrical sound signal in response to a sound received thereby;

wherein:

said securing unit includes a pair of clamping members spaced apart from each other in a first direction, and configured to clamp the resonance box portion therebetween, each of said clamping members including:

a positioning mechanism configured to position said clamping member on said base unit; and a clamping component pivotally mounted to said positioning mechanism for rotation between a functional position at which said clamping component is disposed to abut against the resonance box portion, and a non-functional position at which said clamping component is folded toward said base unit in the first direction.

12. A pickup device for a string instrument having a resonance box portion, comprising:

a base unit to be disposed at a rear side of the string instrument;

a securing unit disposed on said base unit and configured to secure removably said base unit to the string instrument; and a sound pickup unit mounted to said base unit and configured to generate an electrical sound signal in response to a sound received thereby;

wherein:

said securing unit includes a pair of clamping members spaced apart from each other in a first direction, and configured to clamp the resonance box portion therebetween, each of said clamping members including:

a positioning mechanism configured to position said clamping member on said base unit; and a clamping component pivotally mounted to said positioning mechanism for rotation between a functional position at which said clamping component is disposed to abut against the resonance box portion, and a non-functional position at which said clamping component is folded toward said base unit; and said base unit includes:

a base body extending in the first direction, and configured for disposing said positioning mechanism of each of said clamping members thereon;

a plate mounted to and movable along one of longitudinal end parts of said base body that are disposed along the first direction, and bending away from said securing unit; and a fixing component for fixing an extended length of said plate with respect to said base body.

* * * * *